US010254674B2

(12) United States Patent
Seki et al.

(10) Patent No.: US 10,254,674 B2
(45) Date of Patent: Apr. 9, 2019

(54) CARRIER FOR DEVELOPER OF ELECTROSTATIC LATENT IMAGE, DEVELOPER, AND IMAGE FORMING APPARATUS

(71) Applicants: Masahiro Seki, Shizuoka (JP); Hiroyuki Kishida, Shizuoka (JP); Haruki Murata, Kanagawa (JP); Shinya Nakagawa, Shizuoka (JP); Kei Niwayama, Shizuoka (JP); Saori Yamada, Shizuoka (JP); Kohsuke Miyazaki, Shizuoka (JP)

(72) Inventors: Masahiro Seki, Shizuoka (JP); Hiroyuki Kishida, Shizuoka (JP); Haruki Murata, Kanagawa (JP); Shinya Nakagawa, Shizuoka (JP); Kei Niwayama, Shizuoka (JP); Saori Yamada, Shizuoka (JP); Kohsuke Miyazaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 4 days.

(21) Appl. No.: 15/730,795

(22) Filed: Oct. 12, 2017

(65) Prior Publication Data

US 2018/0113393 A1 Apr. 26, 2018

(30) Foreign Application Priority Data

Oct. 20, 2016 (JP) ..... 2016-206076

(51) Int. Cl.

| | |
|---|---|
| ***G03G 9/107*** | (2006.01) |
| ***G03G 9/113*** | (2006.01) |
| *G03G 15/08* | (2006.01) |

(52) U.S. Cl.
CPC ..... *G03G 9/1131* (2013.01); *G03G 9/1075* (2013.01); *G03G 9/1132* (2013.01); *G03G 9/1139* (2013.01); *G03G 15/0806* (2013.01)

(58) Field of Classification Search
CPC ..... G03G 9/1139; G03G 9/1131
See application file for complete search history.

(56) References Cited

U.S. PATENT DOCUMENTS

| | | |
|---|---|---|
| 9,261,817 B2 | 2/2016 | Iwatsuki et al. |
| 2011/0086307 A1 | 4/2011 | Nakajima et al. |

(Continued)

FOREIGN PATENT DOCUMENTS

| | | |
|---|---|---|
| JP | 2014-077974 A | 5/2014 |
| JP | 2014-153652 A | 8/2014 |

OTHER PUBLICATIONS

U.S. Appl. No. 15/522,306, filed Sep. 29, 2015.

*Primary Examiner* — Peter L Vajda
(74) *Attorney, Agent, or Firm* — Oblon, McClelland, Maier & Neustadt, L.L.P.

(57) ABSTRACT

A carrier for a developer of an electrostatic latent image, the carrier including: core particles having magnetism; and a coating layer coating a surface of each of the core particles, wherein the coating layer includes two or more kinds of inorganic particles, at least one kind of inorganic particles among the two or more kinds of inorganic particles is inorganic particles A having conductivity and a peak particle diameter of from 300 nm through 1,000 nm, and surface roughness of the carrier calculated by Formula 1 below is from 1.10 $m^2/g$ through 1.90 $m^2/g$, $$C-F \qquad \text{Formula 1}$$

where C is a BET specific surface area ($m^2/g$) of the carrier and F is a BET specific surface area ($m^2/g$) of the core particles.

15 Claims, 1 Drawing Sheet

(56) References Cited

U.S. PATENT DOCUMENTS

| | | | | |
|---|---|---|---|---|
| 2011/0091802 | A1 | 4/2011 | Takahashi et al. | |
| 2011/0170915 | A1 | 7/2011 | Aoki et al. | |
| 2011/0171573 | A1* | 7/2011 | Sakata | G03G 9/10 430/111.1 |
| 2011/0229817 | A1 | 9/2011 | Yamada et al. | |
| 2012/0028183 | A1 | 2/2012 | Nakajima et al. | |
| 2012/0057898 | A1 | 3/2012 | Sakata et al. | |
| 2012/0058423 | A1 | 3/2012 | Yamaguchi et al. | |
| 2012/0064451 | A1 | 3/2012 | Kishida et al. | |
| 2012/0230725 | A1 | 9/2012 | Sakata et al. | |
| 2013/0004209 | A1 | 1/2013 | Kishida et al. | |
| 2013/0065175 | A1 | 3/2013 | Sakata et al. | |
| 2013/0252169 | A1 | 9/2013 | Yaguchi et al. | |
| 2014/0023966 | A1 | 1/2014 | Sawada et al. | |
| 2014/0072910 | A1 | 3/2014 | Iwatsuki et al. | |
| 2014/0080052 | A1 | 3/2014 | Yaguchi et al. | |
| 2014/0227638 | A1* | 8/2014 | Kishida | G03G 13/08 430/106.1 |
| 2014/0248557 | A1 | 9/2014 | Yaguchi et al. | |
| 2015/0153665 | A1 | 6/2015 | Kishida et al. | |
| 2016/0363880 | A1 | 12/2016 | Takii et al. | |
| 2017/0153563 | A1 | 6/2017 | Kishida et al. | |
| 2017/0185000 | A1 | 6/2017 | Nagayama et al. | |
| 2017/0205721 | A1 | 7/2017 | Murasawa et al. | |
| 2017/0248871 | A1 | 8/2017 | Iwatsuki et al. | |
| 2017/0269497 | A1 | 9/2017 | Murasawa et al. | |

* cited by examiner

CARRIER FOR DEVELOPER OF ELECTROSTATIC LATENT IMAGE, DEVELOPER, AND IMAGE FORMING APPARATUS

CROSS-REFERENCE TO RELATED APPLICATIONS

The present application claims priority under 35 U.S.C. § 119 to Japanese Patent Application No. 2016-206076 filed Oct. 20, 2016. The contents of which are incorporated herein by reference in their entirety.

BACKGROUND OF THE INVENTION

Field of the Invention

The present disclosure relates to a carrier for a developer of an electrostatic latent image, a developer, and an image forming apparatus.

Description of the Related Art

In the course of image formation of an electrophotography system, an electrostatic latent image is formed on an electrostatic latent image-bearing member, such as photoconductive material, a charged toner is deposited on the electrostatic latent image to form a toner image, and the toner image is then transferred to a recording medium and fixed to form an output image.

Regarding the image formation of an electrophotography system, there is recently a strong need for a carrier to have a prompt charge-imparting capability to a toner to correspond to increased printing speed.

With a charge-imparting capability of a carrier known in the art, a toner cannot be charged because the toner supplied to a developer is not sufficiently charged by frictions. Therefore, there are problems that toner scattering where the toner is accumulated outside a developing device is caused and background deposition where a toner is developed on a white blank area is caused.

Accordingly, to control a charging amount of a toner constant is desired even stronger than ever. Carriers known in the art cannot satisfy the desired properties.

Therefore, various attempts have been made.

For example, proposed is a carrier for a developer of an electrostatic latent image. The carrier is used for a developing device including an image bearer, a developer bearing member including a magnetic field-generating unit inside, and a developer-regulating member disposed to face a surface of the image bearer with the predetermined gap. The carrier includes core particles having magnetism and coating layers covering surfaces of the core particles. A bulk density of the carrier is 1.6 g/cm$^3$ or greater but 2.25 g/cm$^3$ or less, a BET specific surface area of the carrier is 0.5 m$^3$/g or greater but 2.0 m$^3$/g or less, saturation magnetization σ5000 of the carrier as measured with 5 kOe is 70 emu/g or greater, and residual magnetization or of the carrier is 2 emu/g or less (see, for example, Japanese Unexamined Patent Application Publication No. 2014-077974).

Moreover, proposed is a carrier for a developer of an electrostatic latent image where the carrier includes core particles having magnetism and surfaces of the core particles are covered with a resin coating layer including conductive particles. The proposed carrier has a BET specific surface area of 0.8 m$^2$/g or greater but 1.6 m$^2$/g or less (see, for example, Japanese Unexamined Patent Application Publication No. 2014-153652).

Although charging stability can be secured in the proposed techniques, as an adverse effect, dynamic resistance fluctuates over time. As a result, carrier deposition occurs at edge portions of an image, leading to deterioration of image quality.

SUMMARY OF THE INVENTION

According to one aspect of the present disclosure, a carrier for a developer of an electrostatic latent image includes core particles having magnetism and a coating layer coating a surface of each of the core particles. The coating layer includes two or more kinds of inorganic particles. At least one kind of inorganic particles among the two or more kinds of inorganic particles is inorganic particles A having conductivity and a peak particle diameter of from 300 nm through 1,000 nm. Surface roughness of the carrier calculated by Formula 1 below is from 1.10 m$^2$/g through 1.90 m$^2$/g.

C−F Formula 1

C: a BET specific surface area (m$^2$/g) of the carrier
F: a BET specific surface area (m$^2$/g) of the core particles

Figure 1:
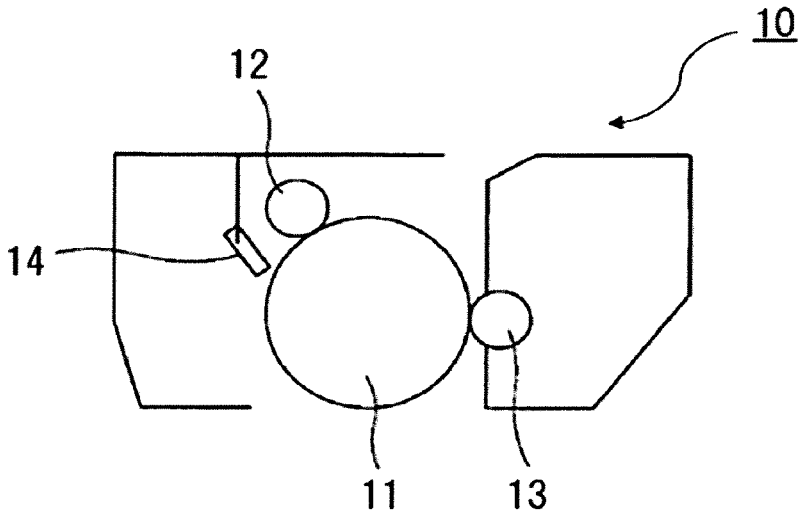
FIG. 1 is a view illustrating one example of a process cartridge associated with the present disclosure.

DESCRIPTION OF THE EMBODIMENTS (Carrier for Developer of Electrostatic Latent Image)

A carrier for a developer of an electrostatic latent image according to the present disclosure includes at least core particles having magnetism and a coating layer coating a surface of each of the core particles. The carrier may further include other ingredients according to the necessity.

The coating layer includes two or more kinds of inorganic particles.

Among the two or more kinds of inorganic particles, at least one kind of inorganic particles is inorganic particles A having conductivity and a peak particle diameter of from 300 nm through 1,000 nm.

Surface roughness of the carrier for a developer of an electrostatic latent image calculated by Formula 1 below is from 1.10 m$^2$/g through 1.90 m$^2$/g.

C−F Formula 1

C: a BET specific surface area (m$^2$/g) of the carrier
F: a BET specific surface area (m$^2$/g) of the core particles The present disclosure has an object to provide a carrier for a developer of an electrostatic latent image, where the carrier can stably supply charge and can achieve stable image quality with inhibiting carrier deposition on edge portions caused by an increase in dynamic resistance due to a long-term storage (particularly in a high temperature and high humidity environment).

The present disclosure can provide a carrier for a developer of an electrostatic latent image, where the carrier can stably supply charge and can achieve stable image quality with inhibiting carrier deposition on edge portions caused by an increase in dynamic resistance due to a long-term storage (particularly in a high temperature and high humidity environment).

In the carrier for a developer of an electrostatic latent image according to the present disclosure, inorganic particles are effectively aligned in the coating layer to give a desired surface area to a surface of a carrier particle.

Moreover, the inorganic particles in the coating layer have an effect of suppressing abrasion of the coating layer and can prevent abrasion of a surface layer of the carrier particle during printing performed over a long period.

Accordingly, the inorganic particles are an important factor for suppressing abrasion of a coating layer of a carrier particle inside a current printer used for high-speed printing.

The present inventors have found that inorganic particles are effectively aligned in a coating layer to obtain a required surface area when at least one kind of the inorganic particles have a peak particle diameter of 300 nm or greater among the two or more kinds of the inorganic particles, and as a result, abrasion of a surface layer (coating layer) of a carrier particle can be prevented by an effect of suppressing abrasion the inorganic particles exhibit.

As a surface area of a carrier particle increases, however, moisture tends to be adsorbed to a surface of the carrier particle. Therefore, an adsorbed moisture amount (or swell of the coating resin or inclusion of water in the coating resin) of the surface of the carrier particle increases when the carrier is stored for a long period in a high temperature and high humidity environment. Therefore, dynamic resistance of the carrier increases. As a result, carrier deposition occurs at edge portions of an image to deteriorate image quality. The carrier deposition at the edge portions becomes significant when the inorganic particles are inorganic particles having conductivity.

In the present specification, the term "dynamic resistance" specifically means a resistance value on a rotator (rotating sleeve) and can be determined from a current value run when voltage is applied during rotating the sleeve on which the carrier is born.

In the present specification, moreover, the edge portion means a region of a developer bearing member, such as a developing roller, and corresponds to a rim of an image to be formed (e.g., a solid image).

In order to prevent an increase of dynamic resistance, a peak particle diameter of the inorganic particles having conductivity is controlled to a range of from 300 nm through 1,000 nm and a difference (C−F) between a BET specific surface area (C) of the carrier for a developer of an electrostatic latent image and a BET specific surface area (F) of the core particles is controlled to a range of from 1.10 $m^2/g$ through 1.90 $m^2/g$.

When the difference (C−F) in the BET specific surface area is greater than 1.90 $m^2/g$, inorganic particles that are not covered with a resin are present in the coating layer and therefore moisture tends to be adsorbed. Since the surface area of the coating layer is large, moreover, an adsorption surface increases to thereby increase a change in a moisture content.

When the difference (C−F) of the BET specific surface areas is less than 1.10 $m^2/g$, moreover, it is difficult to obtain a sufficient charging ability.

In the carrier for a developer of an electrostatic latent image according to the present disclosure, the inorganic particles are effectively aligned in the coating layer to give a desired surface area to a surface of a carrier particle and can prevent abrasion of the surface layer of the carrier particle during printing performed over a long period.

<Particle Diameters of Inorganic Particles>

Particle diameters of the inorganic particles can be confirmed by methods known in the art. In the present disclosure, for example, the particle diameters of the inorganic particles are measured by the following method.

A carrier particle is cut by a focused ion beam (FIB) device and a cross-section of the cut carrier particle is observed by SEM etc. to measure particle diameters of inorganic particles. Note that, the focused ion beam (FIB) device is a device configured to scam an extremely finely focused ion beam over a surface of a sample to detect generated secondary electrons to observe a microscopic image or to process a surface of the sample.

A sample is deposited on a carbon tape and the sample is coated with about 20 nm of osmium for protection of the surface or for a conduction treatment. The FIB treatment is performed by means of NVision 40 available from Carl Zeiss (SII) under the following conditions.

Accelerating voltage: 2.0 kV
Aperture: 30 μm
High Current: ON
Detector: SE2, InLens
Conduction treatment: None
W. D.: 5.0 mm
Inclination of sample: 54°

A SEM observation is performed by means of an electron cooling silicon drift detector (SDD) UltraDry (sensor area: 30 $mm^2$) using an analysis software NORAN System 6 (NSS) available from Thermo Fisher Scientific Inc. under the following conditions.

Accelerating voltage: 3.0 kV
Aperture: 120 μm
High Current: ON
Conduction treatment: Os
Drift correction: Yes
W.D.: 10.0 mm
Measuring method: Area Scan
Cumulative time: 10 sec
Cumulative number: 100 times
Inclination of sample: 54°
Magnification: 10,000 times The result of the SEM observation is taken into a TIFF image and the TIFF image is processed to produce an image of only the particle using Image-Pro Plus available from Media Cybernetics. Thereafter, binarization is performed to separate the image into a white part (particle portion) and a black part (resin portion) and a particle diameter of the white part is measured. As a measurement of a particle diameter of a non-spherical particle, a circle equivalent diameter of the non-spherical particle is determined as a particle diameter. The above-mentioned method is performed on 1,000 particles and a particle size distribution of the particles is plotted.

The plotting is performed on the results that are divided into groups per 5 nm and frequency of 5% or less is not treated as a peak. Moreover, the maximal on the plot is defined as a peak.

A peak particle diameter of the inorganic particles A is from 300 nm through 1,000 nm.

The peak particle diameter being 300 nm or greater means that the inorganic particles as a whole are not small particles. Therefore, detachment of the inorganic particles from the coating layer due to kinetic energy received by the particles of small particle diameters can be prevented, a change in the BET specific surface area of the carrier during printing performed over a long period can be prevented, and a problem associated with charging, such as background deposition, can be improved.

When the peak particle diameter is 1,000 nm or less, moreover, a problem that the inorganic particles are detached because the coating resin cannot be retain the particles of large particle diameters can be prevented, a change in the BET specific surface area of the carrier during printing performed over a long period can be prevented, and a problem associated with charging, such as background deposition, can be improved.

<Surface Roughness>

The surface roughness is calculated by Formula 1 below and is from 1.10 $m^2/g$ through 1.90 $m^2/g$.

The surface roughness is preferably 1.80 $m^2/g$ or less in view of prevention of carrier deposition on edge portions caused by an increase in dynamic resistance due to a long-term storage (particularly under higher temperatures and high humidity).

Moreover, the surface roughness is preferably 1.30 $m^2/g$ or greater and more preferably 1.60 $m^2/g$ or greater in view of prevention of toner scattering.

$$C-F \qquad \text{Formula 1}$$

C: a BET specific surface area ($m^2/g$) of the carrier

F: a BET specific surface area ($m^2/g$) of the core particles

The large BET specific surface area means the large number of times friction charging between the toner and the carrier is performed, means that an area of the carrier capable of imparting charge is large, and means that an efficiency of the carrier to impart charge to the toner is increased.

Therefore the large BET specific surface area contributes to meet the requirement of promptly charging a toner through friction charging for recent trends of a large image area or high-speed printing.

Meanwhile, the BET specific surface area of the carrier is influenced by a BET specific surface area of core particles. Specifically, the BET specific surface area of the carrier changes because surface irregularities of a carrier particle corresponds to surface irregularities of a core particle and therefore.

The large BET specific surface area of a core particle means that a large number of convex portions are present on the core particle. When the BET specific surface area of the core particle is large, the carrier is abraded by receiving kinetic energy generated by friction or crushing caused inside a developing device. When the carrier is abraded to expose the core particle covered with the coating layer to a surface of the carrier particle, charge is leaked from the exposed area to cause low charging ability of the carrier or low resistance of the carrier, leading to background deposition or carrier deposition. It is physically difficult to deposit a material constituting a coating layer onto a convex portion of a core particle and therefore the coating layer is partially thin at the convex portion. At the thin part of the coating layer, the inorganic particles tend to be sparsely present. Since the presence of the inorganic particles tends to be sparse, the thin part becomes a part where abrasion resistance of the coating layer is low. Therefore, the above-mentioned problem tends to occur when more convex portions are present on the core particle. Accordingly, such a carrier will have a critical problem when the carrier is used for long-term printing.

The present inventors have repetitively and diligently performed studies. As a result, the present inventors define surface roughness that is an indicator including the above-mentioned insight. Specifically, the present inventors have found the following insight. By satisfying the index defined by Formula 1 above, the following carrier and developer can be provided. Namely, provided are a carrier and a developer, with which charge control can be sufficiently performed to obtain image quality required in the field of production printing during printing performed over a long period, a stable amount of a developer can be supplied to a developing region, and continuous printing can be performed at a low imaging rate by means of a high-speed device using a low-temperature fixing toner.

<<Measurement of BET Specific Surface Area>>

The BET specific surface area can be measured by measuring 3.5 g of a measurement sample (a carrier or core particles) by means of a BET specific surface area measuring device (Macsorb model-1201, available from Mountech Co., Ltd.).

A measurement of a BET specific surface area of core particles may be performed on core particles used for production of the carrier of the present disclosure or core particles obtained by removing a coating layer from the carrier of the present disclosure. In the latter case, examples of a method for removing a coating layer from the carrier of the present disclosure include a method where a coating layer is removed using chloroform.

<Volume Average Particle Diameter of Carrier>

A volume average particle diameter of the carrier for a developer of an electrostatic latent image is not particularly limited and may be appropriately selected depending on the intended purpose. The volume average particle diameter is preferably from 28 μm through 40 μm. When the volume average particle diameter is within the preferable numerical range, it is advantageous in view of prevention of occurrences of carrier deposition and prevention of deterioration in definition of an image due to low reproducibility of fine parts of the image.

In the present disclosure, a volume average particle diameter of the carrier, core particles, inorganic particles, etc., can be measured, for example, by means of Microtrack particle size distribution meter HRA9320-X100 (available from NIKKISO CO., LTD.).

<BET Specific Surface Area of Carrier>

A BET specific surface area of the carrier for a developer of an electrostatic latent image is not particularly limited and may be appropriately selected depending on the intended purpose. The BET specific surface area is preferably from 1.20 $m^2/g$ through 2.50 $m^2/g$, more preferably from 1.25 $m^2/g$ through 2.30 $m^2/g$, and particularly preferably from 1.30 $m^2/g$ through 2.10 $m^2/g$.

<Core Particles>

The core particles are not particularly limited and may be appropriately selected depending on the intended purpose, as long as the core particles are core particles having magnetism. Examples of the core particles include: ferromagnetic metals, such as iron and cobalt; iron oxides, such as magnetite, hematite, and ferrite; and resin particles where a magnetic substance, such as various alloys and compounds, is dispersed in resin. Among the above-listed examples, Mn-based ferrite, Mn—Mg-based ferrite, and Mn—Mg—Sr-based ferrite are preferable in view of consideration to the environment.

A BET specific surface area of the core particles is not particularly limited and may be appropriately selected depending on the intended purpose. The BET specific surface area is preferably from 0.01 $m^2/g$ through 0.50 $m^2/g$, more preferably from 0.03 $m^2/g$ through 0.35 $m^2/g$, and particularly preferably from 0.05 $m^2/g$ through 0.25 $m^2/g$.

<Coating Layer>

The coating layer includes at least two or more kinds of inorganic particles, preferably includes a resin, and may further include other ingredients according to the necessity.

<<Inorganic Particles>>

The coating layer includes at least two or more kinds of inorganic particles.

Among the two or more kinds of inorganic particles, at least one kind of inorganic particles is inorganic particles A having conductivity and a peak particle diameter of from 300 nm through 1,000 nm.

—Inorganic particles A—

A material of the inorganic particles A is not particularly limited and may be appropriately selected depending on the intended purpose, as long as the material has conductivity. The material of the inorganic particles A is preferably a tin oxide compound. Unlike carbon black, the tin oxide compound does not cause "color staining" where a color a toner has is darkened when the tin oxide compound is used in a color toner, a white toner, or a clear toner. Unlike silver particles, moreover, the tin oxide compound does not cause a problem the silver particles have. Specifically, only a small amount of the silver particles can be added to a coating resin because conductivity of the silver particles is too good and therefore an effect of enhancing a film strength cannot be expected.

In the present specification, the term "conductivity" means that a value of volume resistance is $10^8$ Ω·cm or less and the term "non-conductivity" means a value of volume resistance is greater than $10^8$ Ω·cm.

The tin oxide compound is not particularly limited and may be appropriately selected depending on the intended purpose, as long as the tin oxide compound is an oxide including tin. The tin oxide compound is preferably indium-doped tin oxide (ITO), phosphorus-doped tin oxide (PTO), or tungsten-doped tin oxide (WTO). The above-listed examples may be used alone or in combination.

Inorganic particles other than the inorganic particles A are not particularly limited and may be appropriately selected depending on the intended purpose. Examples of the inorganic particles include non-conductive inorganic particles. Examples of a material of the non-conductive inorganic particles include aluminium oxide, titanium dioxide, zinc oxide, silicon dioxide, barium sulfate, and zirconium oxide.

The inorganic particles other than the inorganic particles A are preferably aluminium oxide particles or barium sulfate particles, and are more preferably barium sulfate particles in view of charging properties.

An amount of the two or more kinds of inorganic particles in the coating layer is not particularly limited and may be appropriately selected depending on the intended purpose. The amount is preferably from 10% by mass through 95% by mass, more preferably from 20% by mass through 90% by mass, and particularly preferably from 30% by mass through 85% by mass.

An amount of the inorganic particles A in the coating layer is not particularly limited and may be appropriately selected depending on the intended purpose. The amount is preferably from 5% by mass through 80% by mass, more preferably from 10% by mass through 70% by mass, and particularly preferably from 15% by mass through 60% by mass.

<<Resin>>

The resin is not particularly limited and may be appropriately selected depending on the intended purpose. Examples of the resin include acrylic resins, amino resins, polyvinyl-based resins, polystyrene-based resins, halogenated olefin resins, polyester, polycarbonate, polyethylene, polyvinyl fluoride, polyvinylidene fluoride, polytrifluoroethylene, polyhexafluoropropylene, vinylidene fluoride-vinyl fluoride copolymers, fluoroterpolymers, such as a terpolymer of tetrafluoroethylene, vinylidene fluoride, and a non-fluoromonomer, and silicone resins. The above-listed examples may be used alone or in combination. Among the above-listed examples, a silicone resin is preferable.

The resin is not particularly limited and may be appropriately selected depending on the intended purpose, but the resin is preferably a resin including a cured product of a mixture including a silane coupling agent and a silicone resin.

—Silicone Resin—

The silicone resin is not particularly limited and may be appropriately selected depending on the intended purpose. The silicone resin is preferably a resin including a cross-linked product obtained by performing hydrolysis of a copolymer including at least an A segment represented by General Formula (A) below and a B segment represented by General Formula (B) below to generate silanol groups and performing condensation of the silanol groups.

General Formula (A)

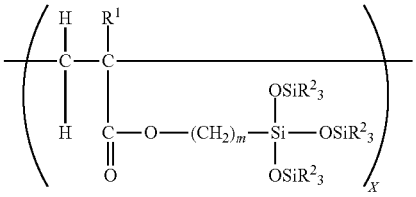

In General Formula (A), $R^1$ is a hydrogen atom or a methyl group, $R^2$ is an alkyl group having from 1 through 4 carbon atoms, m is an integer of from 1 through 8, and X is a molar ratio in the copolymer where X is from 10 mol % through 90 mol % and preferably from 30 mol % through 70 mol %.

General Formula (B)

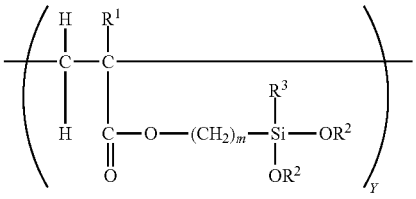

In General Formula (B), $R^1$ is a hydrogen atom or a methyl group, $R^2$ is an alkyl group having from 1 through 4 carbon atoms, $R^3$ is an alkyl group having from 1 through 8 carbon atoms or an alkoxy group having from 1 through 4 carbon atoms, m is an integer of from 1 through 8, and Y is a molar ratio in the copolymer where Y is from 10 mol % through 90 mol % and preferably from 30 mol % through 70 mol %.

Examples of the alkyl group having from 1 through 4 carbon atoms include a methyl group, an ethyl group, a propyl group, an isopropyl group, and a butyl group.

Examples of the alkyl group having from 1 through 8 carbon atoms include a methyl group, an ethyl group, a propyl group, an isopropyl group, a butyl group, a pentyl group, a hexyl group, a heptyl group, and an octyl group.

Examples of the alkoxy group having from 1 through 4 carbon atoms include a methoxy group, an ethoxy group, a propoxy group, and a butoxy group.

——A Segment——

The A segment represented by General Formula (A) includes tris(trimethylsiloxy)silane that is an atom group where many methyl groups are present in a side chain. When a proportion of the A component increases relative to an entire resin, surface energy decreases and therefore deposition of a resin component or wax component of a toner decreases.

Examples of a monomer for forming the A segment include tris(trialkylsiloxy)silane compounds represented by the following formulae.

In the formulae below, Me is a methyl group, Et is an ethyl group, and Pr is a propyl group.

$CH_2{=}CMe\text{-}COO{-}C_3H_6{-}Si(OSiMe_3)_3$ $CH_2{=}CH{-}COO{-}C_3H_6{-}Si(OSiMe_3)_3$ $CH_2{=}CMe\text{-}COO{-}C_4H_8{-}Si(OSiMe_3)_3$ $CH_2{=}CMe\text{-}COO{-}C_3H_6{-}Si(OSiEt_3)_3$ $CH_2{=}CH{-}COO{-}C_3H_6{-}Si(OSiEt_3)_3$ $CH_2{=}CMe\text{-}COO{-}C_4H_8{-}Si(OSiEt_3)_3$ $CH_2{=}CMe\text{-}COO{-}C_3H_6{-}Si(OSiPr_3)_3$ $CH_2{=}CH{-}COO{-}C_3H_6{-}Si(OSiPr_3)_3$ $CH_2{=}CMe\text{-}COO{-}C_4H_8{-}Si(OSiPr_3)_3$ A production method of the monomer for forming the A segment is not particularly limited. The A segment can be obtained by a method where tris(trialkylsiloxy)silane is allowed to react with allyl acrylate or allyl methacrylate in the presence of a platinum catalyst, or a method disclosed in Japanese Unexamined Patent Application Publication No. 11-217389 where methacryloxyalkyl trialkoxysilane and hexaalkyl disiloxane are allowed to react in the presence of carboxylic acid and an acid catalyst.

——B Segment——

The A segment represented by General Formula (B) is formed with a radically-polymerizable bifunctional or trifunctional silane compound.

Examples of the silane compound include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane, and 3-acryloxypropyltri(isopropoxy)silane.

——C Segment——

The copolymer may further include a C segment represented by General Formula (C) below.

General Formula (C)

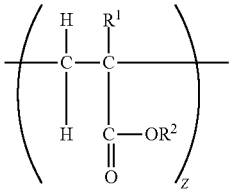

In General Formula (C), $R^1$ is a hydrogen atom or a methyl group, $R^2$ is an alkyl group having from 1 through 4 carbon atoms, and Z is a molar ratio in the copolymer. In General Formulae (A), (B), and (C), X is from 10 mol % through 40 mol %, Y is from 10 mol % through 40 mol %, Z is from 30 mol % through 80 mol %, and 60 mol %<Y+Z<90 mol %.

The C segment imparts flexibility to a resulting coating film and improves adhesion between a core particle and a coating layer.

A monomer C component for generating the C segment is not particularly limited and may be appropriately selected depending on the intended purpose, as long as the monomer C component is an acryl-based compound. The monomer C component is preferably acrylic acid ester or methacrylic acid ester.

The acrylic acid ester or methacrylic acid ester is not particularly limited and may be appropriately selected depending on the intended purpose. Examples of the acrylic acid ester or methacrylic acid ester include methyl methacrylate, methyl acrylate, ethyl methacrylate, ethyl acrylate, butyl methacrylate, butyl acrylate, 2-(dimethylamino)ethylmethacrylate, 2-(dimethylamino)ethylacrylate, 3-(dimethylamino)propylmethacrylate, 3-(dimethylamino)propylacrylate, 2-(diethylamino)ethylmethacrylate, and 2-(diethylamino)ethylacrylate. Among them, alkyl methacrylate is preferable and methyl methacrylate is particularly preferable. Moreover, the above-listed acrylic acid esters or methacrylic acid esters may be used alone or in combination.

A technique for enhancing durability of the coating layer through crosslinking is not particularly limited and may be appropriately selected to depending on the intended purpose. For example, the technique disclosed in Japanese Patent No. 3691115 can be employed.

Japanese Patent No. 3691115 discloses a carrier for developing an electrostatic latent image where the carrier includes magnetic particles and a thermosetting resin covering surfaces of the magnetic particles. The thermosetting resin is prepared by cross-linking a copolymer of organopolysiloxane including a vinyl group at least at a terminal and a radically polymerizable monomer including at least one functional group selected from the group consisting of a hydroxyl group, an amino group, an amide group, and an imide group with an isocyanate-based compound. However, the material disclosed in Japanese Patent No. 3691115 cannot obtain sufficient durability against peeling or scraping of the coating layer.

A reason for the insufficient durability has not been clearly identified, but it is assumed as follows. In case of the thermosetting resin prepared by cross-linking the polymer with the isocyanate-based compound, the number of functional groups to react (crosslink) with the isocyanate compound per unit weight of the copolymer resin is small as seen from the structural formula, and therefore a dense two-dimensional or three-dimensional cross-link structure cannot be formed at cross-linking points. Therefore, peeling or scraping of the coating layer tends to occur (i.e., abrasion resistance of the coating layer is low) when the carrier is used over a long period, and sufficient durability cannot be obtained.

When the coating layer is peeled or scraped, resistance of the carrier decreases to cause a change in image quality and carrier deposition. Moreover, the peeling or scraping of the coating layer deteriorates flowability of a developer to reduce an amount of the developer taken up, causing low image density, background deposition due to an increased toner density, and toner scattering.

Meanwhile, one example of the coating layer of the carrier for a developer of an electrostatic latent image according to the present disclosure is formed of a cross-linked product prepared by cross-linking a copolymer including the large number of bifunctional or trifunctional cross-linkable functional groups (reactive points) (2 times through 3 times more compared to the copolymer disclosed in Japanese Patent No. 3691115) per unit mass. Therefore, the coating layer is extremely tough and it is difficult to scrape the coating layer.

Moreover, the crosslink formed with the siloxane bond in the present disclosure has the larger bonding energy and more stable against heat stress compared to the crosslink formed with the isocyanate compound disclosed in Japanese Patent No. 3691115. Therefore, it is assumed that stability of the coating layer is maintained over time according to the present disclosure.

As the resin, a silicone resin alone, or an acrylic resin alone, or a combination of the silicone resin and the acrylic resin can be used. The acrylic resin has high adhesion and low brittleness hence the acrylic resin has excellent abrasion resistance. On the other hand, the acrylic resin has high surface energy and therefore use of the acrylic resin in combination with a toner that easily causes toner spent may cause a problem that a charge amount decreases due to accumulation of the toner component spent. In this case, the above-described problem can be solved by using a silicone resin in combination. The silicone resin has low surface energy and therefore a toner component is hardly spent. In addition, the silicone resin exhibits an effect of suppressing accumulation of the spent component because a film of the silicone resin is scraped. However, the silicone resin has a disadvantage that the silicone resin has poor abrasion resistance because the silicone resin has weak adhesion and high brittleness. Therefore, it is important to obtain the characteristics of the acrylic resin and the silicone resin with a fine balance. As a result, it is possible to obtain a coating film that hardly causes spent and has abrasion resistance. Since the silicone resin has low surface energy, a toner component is hardly spent on the silicone resin. Since scraping of the film occurs, moreover, an effect of delaying accumulation of the spent component is obtained.

In the present specification, the silicone resin means all silicone resins generally known, in addition to the silicone resin. The silicone resin includes a straight silicone resin formed only of organosiloxane bonds and silicone resins modified with alkyd, polyester, epoxy, acryl, or urethane, but the silicone resin is not limited to the above-listed examples. Examples of a commercial product of the straight silicone resin include: KR271, KR255, and KR152 available from Shin-Etsu Chemical Co., Ltd.; and SR2400, SR2406, and SR2410 available from Dow Corning Toray Co., Ltd. In this case, the silicone resin may be used alone, but the silicone resin may be also used together with other ingredients that perform a cross-linking reaction, or ingredients for adjusting a charge amount of a resultant carrier. Moreover, examples of a commercial product of the modified silicone resin include: KR206 (alkyd-modified), KR5208 (acryl-modified), ES1001N (epoxy-modified), and KR305 (urethane-modified) available from Shin-Etsu Chemical Co., Ltd.; and SR2115 (epoxy-modified) and SR2110 (alkyd-modified) available from Dow Corning Toray Co., Ltd.

——Silane Coupling Agent——

The silane coupling agent can stably disperse the filler.

The silane coupling agent is not particularly limited and may be appropriately selected depending on the intended purpose. Examples of the silane coupling agent include r-(2-aminoethyl)aminopropyltrimethoxysilane, r-(2-aminoethyl)aminopropylmethyldimethoxysilane, r-methacryloxypropyltrimethoxysilane, N-β-(N-vinylbenzylaminoethyl)-r-aminopropyltrimethoxysilane hydrochloride, r-glycidoxypropyltrimethoxysilane, r-mercaptopropyltrimethoxysilane, methyl trimethoxy silane, methyl triethoxy silane, vinyl triacetoxy silane, r-chloropropyl trimethoxy silane, hexamethyl disilazane, r-anilinopropyltrimethoxysilane, vinyl trimethoxy silane, octadecyldimethyl[3-(trimethoxysilyl)propyl]ammonium chloride, r-chloropropylmethyl dimethoxy silane, methyl trichlorosilane, dimethyl dichlorosilane, trimethyl chlorosilane, allyl triethoxy silane, 3-aminopropylmethyldiethoxysilane, 3-aminopropyltrimethoxysilane, dimethyldiethoxysilane, 1,3-divinyltetramethylsilazane, and methacryloxyethyldimethyl(3-trimethoxysilylpropyl) ammonium chloride. The above-listed examples may be used alone or in combination.

Examples of a commercial product of the silane coupling agent include AY43-059, SR6020, SZ6023, SH6020, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (all available from Dow Corning Toray Co., Ltd.).

An amount of the silane coupling agent added is not particularly limited and may be appropriately selected depending on the intended purpose. The amount is preferably from 0.1% by mass through 10% by mass relative to the resin.

—Polycondensation Catalyst—

When the silane coupling is used, a polycondensation catalyst is preferably used.

Examples of the polycondensation catalyst include titanium-based catalysts, tin-based catalysts, zirconium-based catalysts, and aluminium-based catalysts.

Among the above-listed various catalysts, titanium-based catalysts give excellent results. Among the titanium-based catalysts, titanium diisopropoxybis(ethylacetate) is particularly preferable as a catalyst. The titanium diisopropoxybis (ethylacetate) has a significant effect of accelerating a condensation reaction of a silanol group and the catalyst is not easily deactivated.

(Developer)

The developer includes the above-described carrier for a developer of an electrostatic latent image according to the present disclosure and a toner.

<Toner>

The toner includes at least a binder, and may further include other ingredients, such as a colorant, a charge-controlling agent, and a release agent, according to the necessity.

The toner is a clear toner, a monochromic toner, or a color toner.

The clear toner is a toner that does not include a colorant.

The toner may include a release agent in order for the toner to be used in an oil-less system where an oil for preventing adherence of a toner is not applied to a fixing roller.

Generally, the toner including the release agent tends to cause filming. Since the carrier of the present disclosure can suppress filming, the developer of the present disclosure can maintain excellent quality over a long period.

Moreover, a color toner, especially a yellow toner, generally has a problem that color staining occurs due to scraping of coating layers of carrier particles. However, the developer of the present disclosure can inhibit occurrences of color staining.

The toner can be produced by a method known in the art, such as a pulverization method and a polymerization method. In a case where the toner is produced by the pulverization method, for example, first, toner materials are kneaded to obtain a melt-kneaded product, the melt-knead product is cooled, and then the cooled melt-kneaded product is pulverized, followed by performing classification, to thereby produce base particles. In order to further improve transferring performance and durability, subsequently, external additives are added to the base particles to thereby produce a toner.

A device for kneading the toner material is not particularly limited. Examples of the device include: batch-type twin rolls; Banbury mixers; continuous twin screw extruders, such as KTK twin-screw extruder (available from Kobe Steel, Ltd.), TEM twin-screw kneader (available from TOSHIBA MACHINE CO., LTD.), a twin-screw extruder (available from KCK), PCM twin-screw extruder (available from IKEGAI), and KEX twin-screw extruder (available from Kurimoto, Ltd.); and continuous single screw kneaders, such as a co-kneader (available from BUSS).

When the cooled melt-kneaded product is pulverized, the melt-kneaded product is roughly pulverized by means of a hummer mill, Rotoplex, etc., followed by finely pulverizing the resultant using a fine pulverizer using a jet flow or a mechanical fine pulverizer. Note that, the pulverization is preferably performed in a manner that an average particle diameter of the resultant particles is to be from 3 μm through 15 μm.

When the pulverized melt-kneaded product is classified, moreover, a wind classifier etc. can be used. Note that, the classification is preferably performed in a manner that an average particle diameter of the base particles is to be from 5 μm through 20 μm.

When external additives are added to the base particles, moreover, the external additives are crushed and deposited on surfaces of the base particles by mixing and stirring using a mixer etc.

<<Binder Resin>>

The binder resin is not particularly limited. Examples of the binder resin include: homopolymers of styrenes and substituted products of styrenes, such as polystyrene, poly (p-styrene), and polyvinyl toluene; styrene-based copolymers, such as styrene-p-chlorostyrene copolymers, styrene-propylene copolymers, styrene-vinyl toluene copolymers, styrene-methyl acrylate copolymers, styrene-ethyl acrylate copolymers, styrene-methacrylic acid copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-vinyl methyl ether copolymers, styrene-methyl vinyl ketone copolymers, styrene-butadiene copolymers, styrene-isoprene copolymers, and styrene-maleic acid ester copolymers; polymethyl methacrylate; polybutyl methacrylate; polyvinyl chloride; polyvinyl acetate; polyethylene; polyester; polyurethane; epoxy resins; polyvinyl butyral; polyacrylate; rosin; modified rosin; terpene resin; phenol resin; aliphatic or aromatic hydrocarbon resins; and aromatic-based petroleum resins. The above-listed examples may be used in combination.

The bind resin for pressure fixing is not particularly limited. Examples of the binder resin for pressure fixing include: polyolefin such as low-molecular-weight polyethylene and low-molecular-weight polypropylene; olefin copolymers, such as ethylene-acrylic acid copolymers, ethylene-acrylic acid ester copolymers, styrene-methacrylic acid copolymers, ethylene-methacrylic acid ester copolymers, ethylene-vinyl chloride copolymers, ethylene-vinyl acetate copolymers, and ionomer resins; epoxy resins; polyester; styrene-butadiene copolymers; polyvinyl pyrrolidone; methyl vinyl ether-maleic anhydride copolymers; maleic acid-modified phenol resins; and phenol-modified terpene resins. The above-listed examples may be used in combination.

<<Other Ingredients>>

Examples of the above-mentioned other ingredients include a colorant, a release agent, a charge-controlling agent, and external additives.

—Colorant—

The colorant (pigment or dye) is not particularly limited. Examples of the colorant include: yellow pigments, such as cadmium yellow, mineral fast yellow, nickel titanium yellow, Naples yellow, Naphthol Yellow S, Hansa Yellow G, Hansa Yellow 10G, Benzidine Yellow GR, quinoline yellow lake, Permanent Yellow NCG, and tartrazine lake; orange pigments, such as molybdate orange, Permanent Orange GTR, pyrazolone orange, Vulcan orange, Indanthrene Brilliant Orange RK, benzidine orange G, and Indanthrene Brilliant Orange GK; red pigments, such as red iron oxide, cadmium red, Permanent Red 4R, lithol red, pyrazolone red, watching red calcium salt, Lake Red D, Brilliant Carmine 6B, eosin lake, Rhodamine Lake B, alizarin lake, and Brilliant Carmine 3B; violet pigments, such as Fast Violet B and methyl violet lake; blue pigments, such as cobalt blue, alkali blue, Victoria blue lake, phthalocyanine blue, metal-free phthalocyanine blue, partially chlorinated phthalocyanine blue, fast sky blue, and Indanthrene Blue BC; green pigments, such as chrome green, chromium oxide, Pigment Green B, and malachite green lake; and black pigments, such as carbon black, oil furnace black, channel black, lamp black, acetylene black, azine dyes (e.g., aniline black), metal salts of azo dyes, metal oxides, and composite metal oxides. The above-listed examples may be used in combination.

—Release Agent—

The release agent is not particularly limited. Examples of the release agent include polyolefin (e.g., polyethylene and polypropylene), fatty acid metal salts, fatty acid esters, paraffin wax, amide-based wax, polyvalent alcohol wax, silicone varnish, carnauba wax, and ester wax. The above-listed examples may be used in combination.

—Charge-Controlling Agent—

The charge-controlling agent is not particularly limited. Examples of the charge-controlling agent include: nigrosine; azine-based dyes including alkyl groups having from 2 through 16 carbon atoms (see Japanese Examined Patent Publication No. 42-1627); basic dyes, such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000); lake pigments of the above-listed basic dyes; quaternary ammonium salts, such as C.I. Solvent Black 8 (C.I. 26150), benzoylmethylhexadecyl ammonium chloride, and decyltrimethyl chloride; alkyl tin compounds such as dibutyl tin compounds and dioctyl tin compounds; dialkyl tin borate compounds; guanidine derivatives; polyamine resins, such as vinyl-based polymers including amino groups and condensate-based polymers including amino groups; metal complex salts of monoazo dyes disclosed in Japanese Examined Patent Publication Nos. 41-20153, 43-27596, 44-6397, and 45-26478; salicylic acids disclosed in Japanese Examined Patent Publication Nos. 55-42752 and 59-7385; metal (e.g., Zn, Al, Co, Cr, and Fe) complexes of dialkyl salicylate, naphthoic acid, and dicarboxylic acid; sulfonated copper phthalocyanine pigments; organic boron salts; fluorine-containing quaternary ammonium salts; and calixarene-based compounds. The above-listed examples may be used in combination. Note that, white metal salts of salicylic acid derivatives etc. are preferable for a color toner other than a black toner.

—External Additives—

The external additives are not particularly limited. Examples of the external additives include: inorganic particles, such as silica, titanium oxide, alumina, silicon carbide, silicon nitride, and boron nitride; and resin particles having an average particle diameter of from 0.05 μm through 1 μm obtained by a soap-free emulsion polymerization method, such as polymethyl methacrylate particles and polystyrene particles. The above-listed examples may be used in combination. Among the above-listed examples, metal oxide particles, such as silica and titanium oxide surfaces of which are subjected to a hydrophobic treatment, are preferable. Moreover, a toner having excellent charging stability against humidity can be obtained by using hydrophobic-treated silica and hydrophobic-treated titanium oxide in combination and adjusting an amount of the hydrophobic-treated titanium oxide larger than an amount of the hydrophobic-treated silica.

(Process Cartridge)

A process cartridge for use in the present disclosure includes an electrostatic latent image bearing member and a developer unit that is configured to develop an electrostatic latent image formed on the electrostatic latent image bearing member with a developer including the carrier for a developer of an electrostatic latent image of the present disclosure described above and a toner, where the electrostatic latent image bearing member and the developing unit are integrated.

An embodiment of the process cartridge associated in the present disclosure will be described with reference to FIG. 1.

As illustrated in FIG. 1, a process cartridge 10 includes an electrostatic latent image-bearing member 11, a charging device 12 configured to charge the electrostatic latent image-bearing member, a developing device 13 configured to develop the electrostatic latent image formed on the electrostatic latent image-bearing member with the developer of the present disclosure to form a toner image, and a cleaning device 14 configured to remove the toner remained on the electrostatic latent image-bearing member after transferring the toner image formed on the electrostatic latent image-bearing member to a recording medium. The process cartridge 10 is detachable to a main body of an image forming apparatus, such as a photocopier and a printer.

(Image Forming Apparatus and Image Forming Method)

An image forming apparatus of the present disclosure includes at least an electrostatic latent image-forming unit configured to form an electrostatic latent image on an electrostatic latent image-bearing member, a developing unit configured to develop the electrostatic latent image formed on the electrostatic latent image-bearing member with a developer including the carrier for a developer of an electrostatic latent image according to the present disclosure and a toner to thereby form a toner image, a transferring unit configured to transfer the toner image formed on the electrostatic latent image-bearing member to a recording medium; and a fixing unit configured to fix the toner image transferred to the recording medium. The image forming apparatus may further include other units according to the necessity.

The developing unit configured to form the toner image is not particularly limited and may be appropriately selected depending on the intended purpose, but the developing unit is preferably a unit configured to develop with a developer formed into a magnetic brush to form a toner image.

An image forming method for use in the present disclosure includes a step including forming an electrostatic latent image on an electrostatic latent image-bearing member, a step including developing the electrostatic latent image formed on the electrostatic latent image-bearing member with a developer including the carrier for a developer of an electrostatic latent image according to the present disclosure and a toner to form a toner image, a step including transferring the toner image formed on the electrostatic latent image-bearing member to a recording medium, and a step including fixing the toner image transferred to the recording medium. The image forming method may further include other steps according to the necessity.

The step including developing to form the toner image is not particularly limited and may be appropriately selected depending on the intended purpose, but the step is preferably a step including developing with a developer formed into a magnetic brush to form a toner image.

An embodiment of the image forming apparatus of the present disclosure will be described with reference to FIG. 2.

Figure 2:
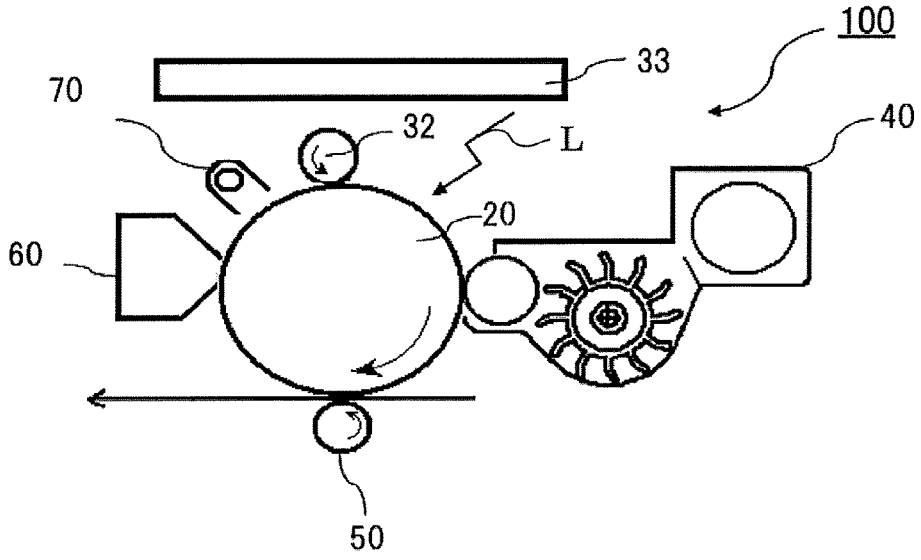
FIG. 2 is a view illustrating one example of an image forming apparatus of the present disclosure.

As illustrated in FIG. 2, first, an electrostatic latent image-bearing member 20 is rotationally driven at the predetermined rim speed and a circumferential surface of the electrostatic latent image-bearing member 20 is uniformly charged to the predetermined positive or negative charge by a charging device 32. Next, the circumferential surface of the electrostatic latent image-bearing member 20 is exposed by an exposure device 33 to sequentially form an electrostatic latent image. Moreover, the electrostatic latent image formed on the circumferential surface of the electrostatic latent image-bearing member 20 is developed with a developer including the carrier for a developer of an electrostatic latent image according to the present disclosure and a toner by means of a developing device 40, to thereby form a toner image. Next, the toner image formed on the circumferential surface of the electrostatic latent image-bearing member 20 is sequentially transferred to a transfer sheet that is fed between the electrostatic latent image-bearing member 20 and a transfer device 50 from the paper feeding unit with synchronizing with the rotations of the electrostatic latent image-bearing member 20. The transfer sheet to which the toner image has been transferred is separated from the circumferential surface of the electrostatic latent image-bearing member 20 and is introduced into a fixing device to fix the toner image, followed by printing out as a copy to the outside of an image forming apparatus 100. Meanwhile, the surface of the electrostatic latent image-bearing member 20 after the toner image is transferred is cleaned by removing the remained toner by a cleaning device 60, followed by eliminating the charge by a charge-eliminator 70, to be ready for the next image formation to be repeated.

Note that, in FIG. 2, "L" is laser light emitted from the exposure device 33.

EXAMPLES

The present disclosure will be described in more detail by way of the following Examples. However, the present disclosure should not be construed as being limited to these Examples. Note that, "part(s)" means "part(s) by mass" unless otherwise stated.

Particle diameters of inorganic particles, a BET specific surface area of core particles, a specific surface area of a carrier, and a volume average particle diameter of the carrier etc. were measured by the methods described above using the following devices.

<Particle Diameters of Inorganic Particles>

Focused ion beam (FIB) device: NVision 40 available from Carl Zeiss (SII)

SEM observation: electron-cooling silicon drift detector (SDD), UltraDry (sensor area: 30 $mm^2$) available from available from Thermo Fisher Scientific Inc.

Binarization treatment: Image-Pro Plus available from Media Cybernetics

<BET Specific Surface Area>

BET specific surface area measuring device: Macsorb model-1201 available from Mountech Co., Ltd.

<Volume Average Particle Diameter>

Microtrack particle size distribution meter HRA9320-X100 (available from NIKKISO CO., LTD.)

Core Production Example 1

$MnCO_3$ powder, $Mg(OH)_2$ powder, $Fe_2O_3$ powder, and $SrCO_3$ powder were weighted and mixed to obtain a powder mixture. The powder mixture was calcinated for 2 hours at 800° C. in a heating furnace in the air. The obtained calcinated product was cooled, followed by pulverizing the calcinated product to obtain powder having particle diameters of 3 μm or less. The powder together with a dispersing agent in an amount of 1% by mass were added to water to prepare a slurry. The slurry was provided to a spray dryer to atomize, to thereby atomizer particles having an average particle diameter of about 40 μm. The atomized particles were placed in a firing furnace and were fired for 4 hours at 1,120° C. in the art to thereby obtain a fired product.

After pulverizing the obtained fired product by a pulverizer, a particle size of the resultant was adjusted through sieving to thereby obtain spherical ferrite particles C1 having a volume average particle diameter of about 35 μm and a BET specific surface area of 0.18 $m^2/g$.

The volume average particle diameter was measured by means of Microtrack particle size distribution meter HRA9320-X100 (available from NIKKISO CO., LTD.) in water with setting a material refractive index to 2.42, a solvent refractive index to 1.33, and a concentration to about 0.06.

Core Production Example 2

$MnCO_3$ powder, $Mg(OH)_2$ powder, and $Fe_2O_3$ powder were weighted and mixed to obtain a powder mixture. The powder mixture was calcinated for 3 hours at 900° C. in a heating furnace in the air. The obtained calcinated product was cooled, followed by pulverizing the calcinated product to obtain powder having particle diameters of approximately 7 μm. The powder together with a dispersing agent in an amount of 1% by mass were added to water to prepare a slurry. The slurry was provided to a spray dryer to atomize, to thereby atomizer particles having an average particle diameter of about 40 μm.

The atomized particles were loaded in a firing furnace and were fired for 5 hours at 1,150° C. in the art to thereby obtain a fired product. After pulverizing the obtained fired product by a pulverizer, a particle size of the resultant was adjusted through sieving to thereby obtain spherical ferrite particles C2 having a volume average particle diameter of about 35 μm and a BET specific surface area of 0.07 $m^2/g$.

The volume average particle diameter was measured by means of Microtrack particle size distribution meter HRA9320-X100 (available from NIKKISO CO., LTD.) in water with setting a material refractive index to 2.42, a solvent refractive index to 1.33, and a concentration to about 0.06.

(Inorganic Particles)

As inorganic particles, barium sulfate having a volume average particle diameter of 600 nm was provided as Particles B1 (available from SAKAI CHEMICAL INDUSTRY CO., LTD.).

As another particles, tungsten-doped tin oxide having a volume average particle diameter presented in Table 1 was used as inorganic particles having conductivity.

TABLE 1

| Name of inorganic particles | Volume average particle diameter (nm) |
|---|---|
| W1 | 500 |
| W2 | 300 |
| W3 | 1,000 |
| W4 | 50 |
| W5 | 1,200 |

W1: available from Titan Kogyo, Ltd.
W2: available from Titan Kogyo, Ltd.
W3: available from Titan Kogyo, Ltd.
W4: available from Titan Kogyo, Ltd.
W5: available from Titan Kogyo, Ltd.

Example 1

<Production of Carrier 1>

A mixture including 20 parts of an acrylic resin solution [solid content: 20% by mass], 200 parts of a silicone resin solution [solid content: 20% by mass], 4.0 parts of aminosilane [solid content: 100% by mass], 180 parts of B1 and 100 parts of W1 as inorganic particles, and 20 parts of titanium diisopropoxybis(ethylacetate) TC-750 (available from Matsumoto Fine Chemical Co., Ltd.) as a catalyst was diluted with 1,000 parts of toluene to thereby obtain a resin solution.

The resin solution was used as a coating material and spherical ferrite particles C1 were used as core particles. The resin solution was applied to and dried on the spherical ferrite particles C1 by means of a fluidized bed coater with a nozzle for fin atomization with controlling a temperature inside the fluidized tank to 65° C. The obtained carrier was fired in an electric furnace for 1 hour at 230° C. to obtain Carrier 1.

Examples 2 to 8 and Comparative Examples 1 to 9

<Production of Carriers 2 to 17>

Carriers 2 to 17 were each obtained in the same manner as in Example 1, except that kinds and amounts of inorganic particles were changed as presented in Table 2.

In Table 2, a unit for each numerical value of the amount is "part(s) by mass."

TABLE 2

| | Carrier | Core | Inorganic particles | | Inorganic particles A | | Volume average particle diameter |
|---|---|---|---|---|---|---|---|
| | | | Kind | Amount | Kind | Amount | (nm) |
| Ex. 1 | 1 | C1 | B1 | 180 | W1 | 100 | 38.8 |
| Ex. 2 | 2 | C1 | B1 | 180 | W2 | 100 | 38.9 |
| Ex. 3 | 3 | C1 | B1 | 180 | W3 | 100 | 38.6 |
| Ex. 4 | 4 | C1 | B1 | 50 | W1 | 100 | 38.4 |
| Ex. 5 | 5 | C1 | B1 | 200 | W1 | 30 | 39.2 |
| Ex. 6 | 6 | C2 | B1 | 180 | W1 | 150 | 37.3 |
| Ex. 7 | 7 | C1 | B1 | 75 | W1 | 75 | 39.0 |
| Ex. 8 | 8 | C2 | B1 | 180 | W1 | 100 | 36.7 |
| Comp. Ex. 1 | 9 | C1 | B1 | 180 | W4 | 100 | 38.9 |
| Comp. Ex. 2 | 10 | C1 | B1 | 180 | W5 | 100 | 39.1 |
| Comp. Ex. 3 | 11 | C1 | — | — | W1 | 100 | 38.4 |
| Comp. Ex. 4 | 12 | C1 | B1 | 180 | — | — | 38.7 |
| Comp. Ex. 5 | 13 | C1 | B1 | 100 | W3 | 30 | 38.8 |
| Comp. Ex. 6 | 14 | C1 | B1 | 180 | W2 | 200 | 39.2 |
| Comp. Ex. 7 | 15 | C1 | B1 | 180 | W4 | 30 | 39.2 |
| Comp. Ex. 8 | 16 | C1 | B1 | 180 | W5 | 180 | 39.2 |
| Comp. Ex. 9 | 17 | C1 | — | — | W1 | 250 | 39.2 |

Toner Production Example 1

—Synthesis of Polyester Resin A—

A reaction tank equipped with a cooling tube, a stirrer, and a nitrogen-inlet tube was charged with 65 parts of a bisphenol A ethylene oxide (2 mol) adduct, 86 parts of a bisphenol A propylene oxide (3 mol) adduct, 274 parts of terephthalic acid, and 2 parts of dibutyl tin oxide, and the resultant mixture was allowed to react for 15 hours at 230° C. under ordinary pressure. Next, the resultant was reacted for 6 hours under the reduced pressure of from 5 mmHg through 10 mmHg to synthesize Polyester Resin A.

Polyester resin A obtained had a number average molecular weight (Mn) of 2,300, a weight average molecular weight (Mw) of 8,000, glass transition temperature (Tg) of 58° C., an acid value of 25 mgKOH/g, and a hydroxyl value of 35 mgKOH/g.

—Synthesis of Styrene-Acryl Resin A—

A reaction tank equipped with a cooling tube, a stirrer, and a nitrogen-inlet tube was charged with 300 parts of ethyl acetate, 185 parts of styrene, 115 parts of an acryl monomer, and 5 parts of azobisisobutyl nitrile. The resultant mixture was allowed to react for 8 hours at 65° C. (ordinary pressure) in a nitrogen atmosphere. Next, 200 parts of methanol was added to the resultant, and the mixture was stirred for 1 hour. Thereafter, the supernatant was removed, and the residues were dried under the reduced pressure to synthesize Styrene-Acryl Resin A.

Styrene-Acryl Resin A obtained had Mw of 20,000 and Tg of 58° C.

—Synthesis of Prepolymer (Polymer Reactable with Active Hydrogen Group-Containing Compound)—

A reaction vessel equipped with a cooling tube, a stirrer, and a nitrogen-inlet tube was charged with 682 parts of a bisphenol A ethylene oxide (2 mol) adduct, 81 parts of a bisphenol A propylene oxide (2 mol) adduct, 283 parts of terephthalic acid, 22 parts of trimellitic anhydride, and 2 parts of dibutyl tin oxide. The resultant mixture was allowed to react for 8 hours at 230° C. under ordinary pressure. Subsequently, the resultant was reacted for 5 hours under the reduced pressure of from 10 mmHg through 15 mmHg to synthesize intermediate polyester.

The obtained intermediate polyester had a number average molecular weight (Mn) of 2,100, a weight average molecular weight (Mw) of 9,600, glass transition temperature (Tg) of 55° C., an acid value of 0.5 mgKOH/g, and a hydroxyl value of 49 mgKOH/g.

Next, a reaction vessel equipped with a cooling tube, a stirrer, and a nitrogen-inlet tube was charged with 411 parts of the intermediate polyester, 89 parts of isophorone diisocyanate, and 500 parts of ethyl acetate, and the resultant mixture was allowed to react for 5 hours at 100° C. to synthesize a prepolymer (a polymer reactable with the active hydrogen group-containing compound).

An amount of free isocyanate of the obtained prepolymer was 1.60% by mass and a solid content of the prepolymer (after leaving to stand for 45 minutes at 150° C.) was 50% by mass.

—Synthesis of Ketimine Compound (the Active Hydrogen Group-Containing Compound)—

A reaction vessel set with a stirring rod and a thermometer was charged with 30 parts of isophorone diamine and 70 parts of methyl ethyl ketone. The resultant mixture was allowed to react for 5 hours at 50° C. to synthesize a ketimine compound (the active hydrogen group-containing compound). The obtained ketimine compound (the active hydrogen group-containing compound) had an amine value of 423.

—Production of Master Batch—

By means of HENSCHEL MIXER (available from NIPPON COKE & ENGINEERING CO., LTD.), 1,000 parts of water, 540 parts of carbon black Printex35 (available from Degussa AG) having DBP oil absorption of 42 mL/100 g and pH of 9.5, and 1,200 parts of Polyester Resin A were mixed. The obtained mixture was kneaded by means of two rolls for 30 minutes at 150° C., followed by rolling and cooling the kneaded product. The resultant was pulverized by means of a pulverizer (available from HOSOKAWA MICRON CORPORATION).

—Preparation of Aqueous Medium—

Ion-exchanged water (306 parts), 265 parts of a 10% by mass tricalcium phosphate suspension liquid, and 1.0 part of sodium dodecylbenzenesulfonate were mixed and stirred to homogeneously dissolve to thereby prepare an aqueous medium.

——Measurement of Critical Micelle Concentration——

A critical micelle concentration of a surfactant was measured by the following method. By means of a surface tensiometer Sigma (available from KSV Instruments), an analysis was performed using an analysis program installed in the Sigma system. The surfactant was dripped in an amount of 0.01% by mass per drop to the aqueous medium and the mixture was stirred. After leaving to stand, a surface tension was measured. The surfactant concentration at which the surface tension stopped decreasing by the dripping of the surfactant was calculated as a critical micelle concentration from the obtained surface tension curve. A critical micelle concentration of sodium dodecylbenzenesulfonate to the aqueous medium was measured by the surface tensiometer Sigma. As a result, the critical micelle concentration was 0.05% by mass relative to the mass of the aqueous medium.

—Preparation of Toner Material Solution—

A beaker was charged with 70 parts of Polyester Resin A, 10 parts of the prepolymer, and 100 parts of ethyl acetate and the resultant mixture was stirred and dissolved. To the resultant, 5 parts of paraffin wax (HNP-9 available from NIPPON SEIRO CO., LTD., melting point: 75° C.) as a release agent, 2 parts of MEK-ST (available from NISSAN CHEMICAL INDUSTRIES, LTD.) as a particle adjuster, and 10 parts of the master batch were dispersed by passing through a bead mill, Ultraviscomill (available from IMEX Co., Ltd.) 3 times under conditions that a feeding speed was 1 kg/h, a rim speed of a disk was 6 m/sec, zirconium beads having a particle diameter of 0.5 mm were packed at 80 vol %. Thereafter, 2.7 parts by mass of the ketimine compound was added to the resultant and dissolved, to thereby prepare a toner material solution.

—Preparation of Emulsion or Dispersion Liquid—

A vessel was charged with 150 parts of the aqueous medium and the aqueous medium was stirred at the revolution speed of 12,000 rpm by a TK homomixer (available from PRIMIX Corporation). To the aqueous medium, 100 parts of the toner material solution was added and the resultant mixture was mixed for 10 minutes to prepare an emulsion or dispersion liquid (emulsified slurry).

—Removal of Organic Solvent—

A flask set with a stirrer and a thermometer was charged with 100 parts of the emulsified slurry. With stirring the emulsified slurry at the stirring peripheral speed of 20 m/min, the solvent was removed from the emulsified slurry for 12 hours at 30° C. to thereby prepare a dispersion slurry.

—Washing—

The dispersion slurry (100 parts) was filtered under the reduced pressure to obtain a filtration cake. To the filtration cake, 100 parts of ion-exchanged water was added and the resultant was mixed by means of a TK homomixer (for 10 minutes at the revolution speed of 12,000 rpm) followed by performing filtration. To the obtained filtration cake, 300 parts of ion-exchanged water was added and the resultant was mixed by the TK homomixer (for 10 minutes at the revolution speed of 12,000 rpm) followed by performing filtration, a series of the processes of which was performed twice. To the obtained filtration cake, 20 parts of a 10% by mass sodium hydroxide aqueous solution was added and the resultant was mixed by the TK homomixer (for 30 minutes at the revolution speed of 12,000 rpm) followed by performing filtration under the reduced pressure. To the obtained filtration cake, 300 parts of ion-exchanged water was added and the resultant was mixed by the TK homomixer (for 10 minutes at the revolution speed of 12,000 rpm). To the obtained filtration cake, 300 parts of ion-exchanged water was added and the resultant was mixed by the TK homomixer (for 10 minutes at the revolution speed of 12,000 rpm) followed by performing filtration, a series of the processes of which was performed twice. To the obtained filtration cake, 20 parts of 10% by mass hydrochloric acid was further added and the resultant was mixed by the TK homomixer (for 10 minutes at the revolution speed of 12,000 rpm) followed by performing filtration.

—Adjustment of Surfactant Amount—

When 300 parts of ion-exchanged water was added to the filtration cake obtained by the washing above and the resultant mixture was mixed by the TK homomixer (for 10 minutes at the revolution speed of 12,000 rpm), electrical conductivity of the toner dispersion liquid was measured. A surfactant concentration of the toner dispersion liquid was calculated from the calibration curve of the surfactant concentration prepared in advance. From the calculated value, ion-exchanged water was added to adjust the surfactant concentration to the target surfactant concentration that was 0.05% by mass, to thereby obtain a toner dispersion liquid.

—Surface Treatment—

With mixing the toner dispersion liquid which had been adjusted to have the predetermined surfactant concentration by the TK homomixer at 5,000 rpm, the toner dispersion liquid was heated in a water bath for 10 hours at the heating temperature T1 of 55° C. Thereafter, the toner dispersion liquid was cooled to 25° C. and the resultant was subjected to filtration. To the obtained filtration cake, 300 parts by mass of ion-exchanged water was further added and the resultant was mixed by the TK homomixer (for 10 minutes at the revolution speed of 12,000 rpm) followed by performing filtration.

—Drying—

The obtained final filtration cake was dried by an air circulation dryer for 48 hours at 45° C. and the resultant was sieved through a mesh having an opening size of 75 μm to thereby obtain Toner Base Particles 1.

—External Additive Treatment—

To 100 parts of Toner Base Particles 1, moreover, 3.0 parts of hydrophobic silica having an average particle diameter of 100 nm, 1.0 part by mass of titanium oxide having an average particle diameter of 20 nm, and 1.5 parts of hydrophobic silica fine powder having an average particle diameter of 15 nm were added and mixed by HENSCHEL MIXER to thereby obtain Toner 1.

(Production 1 of Developer)

Each of Carriers 1 to 17 (930 parts) obtained in Examples 1 to 8 and Comparative Examples 1 to 9 and Toner 1 (70 parts) were mixed and stirred by a turbula mixer for 5 minutes at 81 rpm to produce each of Developers 1 to 17 for evaluations.

Moreover, a developer for supply was produced using the carrier and the toner in a manner that a toner concentration was to be 95% by mass.

<Evaluations of Properties of Developer>

An image evaluation was performed using the obtained developer and RICOH Pro C7110S (digital photocopier-printer multifunction peripheral available from Ricoh Company Limited) available from Ricoh Company Limited.

The machine above was placed in an environment evaluation room (a normal temperature normal humidity environment of 25° C. and 55%) and left for 1 day. Thereafter, evaluations were performed using Developers 1 to 17 of Examples and Comparative Examples and Toner 1.

The results are presented in Table 3.

<<Toner Scattering>>

After outputting 100,000 sheets of a letter chart having an image area ratio of 5% (a size of one letter was about 2 mm×2 mm), a blank image was output to evaluate a degree of background deposition due to scattering of the toner.

Specifically, ID was measured by means of X-Rite (X-Rite 938 D50, available from AMTEC CO., LTD.) and an evaluation was performed based on a difference in ΔID with the blank sheet.

As the evaluation, "A: very good," "B: good," and "C: acceptable level" were determined as acceptable and "D: level that cannot be used on practical use" was determined as unacceptable.

[Evaluation Criteria]

A: $0.02<\Delta ID\leq 0.04$

B: $0.04<\Delta ID\leq 0.10$

C: $0.10<\Delta ID\leq 0.20$

D: $0.20<\Delta ID$

<<White Mixing Portion in Solid Image Due to Carrier Scattering>>

A solid image was output after outputting an image on 50,000 sheets and after outputting an image on 100,000 sheets and the number of white missing portions in the solid image caused by carrier scattering was counted. The solid image was output on A3-size paper.

As the evaluation, "A: very good," "B: good," and "C: acceptable level" were determined as acceptable and "D: level that cannot be used on practical use" was determined as unacceptable.

[Evaluation Criteria]

A: 0

B: 1

C: 2

D: 3 or more

<<White Missing Portion at Rim of Solid Image Due to Carrier Scattering>>

An image where solid squares each in the size of 1 cm×1 cm were aligned at an interval of 1 cm was output initially and after outputting an image on 50,000 sheets, and the number of white missing portions at the rim of the solid image caused by carrier scattering was counted. The solid image was output on A3-size paper. According to the method as mentioned, deterioration due to carrier deposition on the edges was evaluated.

As the evaluation, "A: very good," "B: good," and "C: acceptable level" were determined as acceptable and "D: level that cannot be used on practical use" was determined as unacceptable.

[Evaluation Criteria]

A: 0

B: 1 through 5

C: 6 through 10

D: 11 or more

<<White Missing Portion at Rim of Solid Image after Storing Developer>>

After leaving the produced developer to stand in the environment of 40° C. and 70% RH for 2 weeks, an image where solid squares each in the size of 1 cm×1 cm were aligned at an interval of 1 cm was output using the developer and the number of white missing portions at the rim of the solid image caused by carrier scattering was counted.

As the evaluation, "A: very good," "B: good," and "C: acceptable level" were determined as acceptable and "D: level that cannot be used on practical use" was determined as unacceptable.

[Evaluation Criteria]

A: 0

B: 1 through 5

C: 6 through 10

D: 11 or more

TABLE 3

| | | | Inorganic particles A | | | | | | Carrier deposition (solid area) | | Carrier deposition (rim of solid) | | |
|---|---|---|---|---|---|---|---|---|---|---|---|---|---|
| | Developer | Carrier | Kind | Peak particle diameter (nm) | C ($m^2/g$) | F | C − F | Toner scattering | 50,000 sheets | 100,000 sheets | Initial | 50,000 sheets | Developer after storage |
| Ex. 1 | 1 | 1 | W1 | 500 | 1.84 | 0.18 | 1.66 | A | A | A | A | A | A |
| Ex. 2 | 2 | 2 | W2 | 300 | 2.00 | 0.18 | 1.82 | A | A | A | A | A | C |
| Ex. 3 | 3 | 3 | W3 | 1,000 | 1.60 | 0.18 | 1.42 | A | A | A | A | B | A |
| Ex. 4 | 4 | 4 | W1 | 500 | 1.43 | 0.18 | 1.25 | C | B | B | A | C | A |
| Ex. 5 | 5 | 5 | W1 | 500 | 1.76 | 0.18 | 1.58 | B | C | C | A | B | A |
| Ex. 6 | 6 | 6 | W1 | 500 | 1.97 | 0.07 | 1.90 | A | A | A | A | A | C |
| Ex. 7 | 7 | 7 | W1 | 500 | 1.30 | 0.18 | 1.12 | C | C | C | A | B | A |
| Ex. 8 | 8 | 8 | W1 | 500 | 1.87 | 0.07 | 1.80 | A | A | A | A | A | A |
| Comp. Ex. 1 | 9 | 9 | W4 | 50 | 2.56 | 0.18 | 2.38 | A | A | A | A | B | D |
| Comp. Ex. 2 | 10 | 10 | W5 | 1,200 | 1.25 | 0.18 | 1.07 | A | B | D | A | D | D |
| Comp. Ex. 3 | 11 | 11 | W1 | 500 | 0.90 | 0.18 | 0.72 | D | A | B | A | B | A |
| Comp. Ex. 4 | 12 | 12 | — | — | 1.30 | 0.18 | 1.12 | B | C | D | A | B | A |
| Comp. Ex. 5 | 13 | 13 | W3 | 1,000 | 1.25 | 0.18 | 1.07 | B | C | C | A | D | D |
| Comp. Ex. 6 | 14 | 14 | W2 | 300 | 2.87 | 0.18 | 2.69 | A | A | B | A | B | D |
| Comp. Ex. 7 | 15 | 15 | W4 | 50 | 2.01 | 0.18 | 1.83 | A | C | D | A | A | C |
| Comp. Ex. 8 | 16 | 16 | W5 | 1,200 | 1.50 | 0.18 | 1.32 | A | C | D | A | C | A |
| Comp. Ex. 9 | 17 | 17 | W1 | 500 | 1.83 | 0.18 | 1.65 | D | B | B | A | C | A |

For example, embodiments of the present disclosure are as follows.

<1> A carrier for a developer of an electrostatic latent image, the carrier including:

core particles having magnetism; and a coating layer coating a surface of each of the core particles, wherein the coating layer includes two or more kinds of inorganic particles, at least one kind of inorganic particles among the two or more kinds of inorganic particles is inorganic particles A having conductivity and a peak particle diameter of from 300 nm through 1,000 nm, and surface roughness of the carrier calculated by Formula 1 below is from 1.10 $m^2/g$ through 1.90 $m^2/g$, C−F Formula 1 where C is a BET specific surface area ($m^2/g$) of the carrier and F is a BET specific surface area ($m^2/g$) of the core particles.

<2> The carrier according to <1>, wherein the surface roughness of the carrier is from 1.10 $m^2/g$ through 1.80 $m^2/g$.

<3> The carrier according to <1> or <2>, wherein the surface roughness of the carrier is from 1.30 $m^2/g$ through 1.80 $m^2/g$.

<4> The carrier according to any one of <1> to <3>, wherein the BET specific surface area of the carrier is from 1.20 $m^2/g$ through 2.50 $m^2/g$.

<5> The carrier according to any one of <1> to <4>, wherein the BET specific surface area of the core particles is from 0.01 $m^2/g$ through 0.50 $m^2/g$.

<6> The carrier according to any one of <1> to <5>, wherein a volume average particle diameter of the carrier is from 28 μm through 40 μm.

<7> The carrier according to any one of <1> to <6>, wherein a material of the inorganic particles A is a tin oxide compound.

<8> The carrier according to <7>, wherein the tin oxide compound is at least one selected from the group consisting of indium-doped tin oxide, phosphorus-doped tin oxide, and tungsten-doped tin oxide.

<9> The carrier according to any one of <1> to <8>, wherein the two or more kinds of inorganic particles include barium sulfate particles.

<10> A developer including:

a toner; and the carrier for a developer of an electrostatic latent image according to any one of <1> to <9>.

<11> An image forming apparatus including:

an electrostatic latent image-forming unit configured to form an electrostatic latent image on an electrostatic latent image-bearing member;

a developing unit configured to develop the electrostatic latent image formed on the electrostatic latent image-bearing member with a developer to form a toner image, where the developer includes the carrier for a developer of an electrostatic latent image according to any one of <1> to <9> and a toner;

a transferring unit configured to transfer the toner image formed on the electrostatic latent image-bearing member to a recording medium; and a fixing unit configured to fix the toner image transferred to the recording medium.

The carrier for a developer of an electrostatic latent image according to any one of <1> to <9>, the developer according to <10>, and the image forming apparatus according to <11> solve the above-described various problems existing in the art and can achieve the above-mentioned object of the present disclosure.

What is claimed is:

1. A carrier for a developer of an electrostatic latent image, the carrier comprising:

core particles having magnetism; and a coating layer coating a surface of each of the core particles, wherein the coating layer includes two or more kinds of inorganic particles, at least one kind of inorganic particles among the two or more kinds of inorganic particles is inorganic particles A having conductivity and a peak particle diameter of from 300 nm through 1,000 nm, and surface roughness of the carrier calculated by Formula 1 below is from 1.10 $m^2/g$ through 1.90 $m^2/g$, $$C-F \qquad \text{Formula 1}$$

where C is a BET specific surface area ($m^2/g$) of the carrier and F is a BET specific surface area ($m^2/g$) of the core particles.

2. The carrier according to claim 1, wherein the surface roughness of the carrier is from 1.10 $m^2/g$ through 1.80 $m^2/g$.

3. The carrier according to claim 1, wherein the surface roughness of the carrier is from 1.30 $m^2/g$ through 1.80 $m^2/g$.

4. The carrier according to claim 1, wherein the BET specific surface area of the carrier is from 1.20 $m^2/g$ through 2.50 $m^2/g$.

5. The carrier according to claim 1, wherein the BET specific surface area of the core particles is from 0.01 $m^2/g$ through 0.50 $m^2/g$.

6. The carrier according to claim 1, wherein a volume average particle diameter of the carrier is from 28 μm through 40 μm.

7. The carrier according to claim 1, wherein a material of the inorganic particles A is a tin oxide compound.

8. The carrier according to claim 7, wherein the tin oxide compound is at least one selected from the group consisting of indium-doped tin oxide, phosphorus-doped tin oxide, and tungsten-doped tin oxide.

9. The carrier according to claim 1, wherein the two or more kinds of inorganic particles include barium sulfate particles.

10. A developer, comprising:

a toner; and the carrier for a developer of an electrostatic latent image according to claim 1.

11. An image forming apparatus, comprising:

an electrostatic latent image-forming unit configured to form an electrostatic latent image on an electrostatic latent image-bearing member;

a developing unit configured to develop the electrostatic latent image formed on the electrostatic latent image-bearing member with a developer to form a toner image, where the developer includes the carrier for a developer of an electrostatic latent image according to claim 1 and a toner;

a transferring unit configured to transfer the toner image formed on the electrostatic latent image-bearing member to a recording medium; and a fixing unit configured to fix the toner image transferred to the recording medium.

12. The carrier according to claim 1, wherein the surface roughness of the carrier is from 1.42 $m^2/g$ through 1.90 $m^2/g$.

13. The carrier according to claim 1, wherein the surface roughness of the carrier is from 1.58 $m^2/g$ through 1.90 $m^2/g$.

14. The carrier according to claim 1, wherein the BET specific surface area of the carrier is from 1.76 $m^2/g$ through 2.50 $m^2/g$.

15. The carrier according to claim 8, wherein at least one kind of inorganic particles is tungsten-doped tin oxide.

* * * * *